US005501891A

United States Patent [19]

Saika et al.

[11] Patent Number: 5,501,891

[45] Date of Patent: Mar. 26, 1996

[54] CUSHIONING STRUCTURE

[75] Inventors: Isamu Saika, Osaka; Kenji Inagaki, Ibaraki, both of Japan

[73] Assignee: Teijin Limited, Osaka, Japan

[21] Appl. No.: 390,585

[22] Filed: Feb. 17, 1995

[30] Foreign Application Priority Data

Apr. 28, 1994 [JP] Japan ..... 6-091888

[51] Int. Cl.[6] ..... A47C 27/12; A47C 27/16; A61G 7/02; B32B 1/06

[52] U.S. Cl. ..... 428/71; 5/448; 5/461; 5/481; 5/901; 139/384 R; 139/387 R; 139/410; 428/74; 428/76; 428/101; 428/116; 428/160; 428/162; 428/166; 428/220

[58] Field of Search ..... 5/448, 461, 481, 5/901; 139/384 R, 387 R, 410; 428/71, 74, 76, 101, 116, 160, 162, 166, 220

[56] References Cited

U.S. PATENT DOCUMENTS 4,015,641 5/1977 Goff, Jr. et al. .

FOREIGN PATENT DOCUMENTS 1-321948 12/1989 Japan .
3-88462 9/1991 Japan .
4-222260 8/1992 Japan .

*Primary Examiner*—James C. Cannon
*Attorney, Agent, or Firm*—Sherman and Shalloway

[57] ABSTRACT

A cushioning structure which is a three-dimensional multiple woven texture formed of a surface layer portion and an intermediate layer portion, characterized in that (i) protuberances are formed on one side or both sides of the surface layer portion at least unidirectionally and have an average height of 2 to 15 mm, an average width of one side of the protuberance being 2 to 30 mm; and that (ii) said intermediate layer portion is formed of one layer or by laminating two or more layers, said layer having a plurality of communicating hollow portions which are arranged in parallel unidirectionally. This cushioning structure is excellent in air permeability, cushioning properties, durability and washability, and is therefore useful as various cushioning materials.

14 Claims, 4 Drawing Sheets

CUSHIONING STRUCTURE

Figure 1:
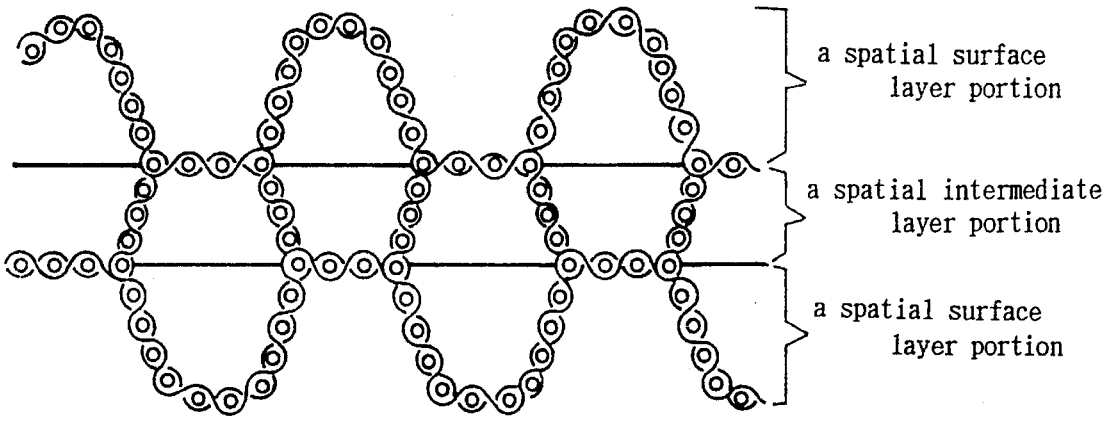

This invention relates to a cushioning structure constituted by a three-dimensional multiple woven texture. More specifically, this invention relates to a cushioning structure constituted by a three-dimensional multiple woven texture, which structure can be used in the fields requiring an air permeability, cushioning properties, washability and the like, such as bed, a sheet for vehicles, a sheet for chair, a sheet for Japanese cushion, a sheet for drawing-room suite, a sports material and the like.

Three-dimensional cushioning structures have been hitherto used in various fields which are roughly classified into a resin form mat typified by an urethane mat, a cushioning fiber structure utilizing a space of a monofilament assembly and a structure of a three-dimensional woven texture utilizing a space of a multiple woven texture. However, these ordinary three-dimensional cushioning structures have defects in practical use. There is a resin foam mat, such as an urethane mat, which has a roughened surface and possesses a controlled compression pressure. Nevertheless, since the internal space is formed of a foam resin, air is not passed therethrough. Thus, the resin foam mat is lacking in air permeability. Especially, the urethane mat has a decreased compression (resistance) pressure when it is used for a long period of time, and then it becomes unusable as a cushioning structure.

On the other hand, the cushioning fiber structure utilizing the space of the monofilament assembly is relatively good in air permeability, but is low in durability. That is, as the cushioning fiber structure is repetitively used, collapse occurs, so that an inner space (void) ratio decreases and cushioning properties are almost lost. Further, in case of the structure of the three-dimensional woven texture utilizing the space of the multiple woven texture, a durability is relatively excellent, but a fiber fillability is high, with the result that an air permeability is poor and cushioning properties are low. Besides, there is a defect that since a big uneven shape is not present on the surface, a pressure distribution hardly becomes uniform.

The hitherto known cushioning materials are explained in detail below.

(1) Japanese Laid-open Patent Application (Kokai) No. 1-321948

This document describes a cushioning woven fabric characterized in that a woven material obtained by using at least two kinds of synthetic resin fibers having a sufficient potential heat shrinkage difference as a warp, or as a weft, or as a warp and a weft is heat-relaxed under suitable temperature conditions to form a wavy resilient surface portion that is formed by flexing of the synthetic resin fiber having a lower heat shrinkage, the flexing being realized by heat shrinkage of the synthetic resin fiber having a higher heat shrinkage to the higher extent. This cushioning woven fabric is either a single-woven cushioning material having a wavy surface or a double-woven, sheet-like cushioning material in which pipy space portions formed by flexing are arranged in parallel and whose both surfaces are flat. The structure of this cushioning material is at most a structure of a monolayered wavy woven fabric, and has poor cushioning properties and insufficient pressure distribution and lacks a durability.

(2) Japanese Laid-open Utility Model Application (Kokai) No. 3-88462

This document describes a shoes mat whose surface material is formed of a cushioning woven fabric in which at least two kinds of synthetic resin fibers having a sufficient potential heat shrinkage difference are used, and a wavy resilient portion is formed by flexing of the synthetic resin fiber having a lower heat shrinkage, the flexing being realized by heat shrinking of the synthetic fiber having a higher heat shrinkage to the higher extent. This cushioning woven fabric is obtained by simply heat-treating a plain fabric or a gauze fabric, and has a thickness of at most about 5 mm. Accordingly, cushioning properties of the fabric are very poor, and said fabric is quite unsuitable as a cushioning material for bed pad or vehicle sheet.

(3) Japanese Laid-open Patent Application (Kokai) No. 4-222260

This document describes a cloth of a three-dimensional structure in which fabric textures of front and back surfaces are connected with connecting yarns and which is knitted with a double raschel knitting machine or a moquette knitting machine, the connecting yarns being two or more kinds of yarns each having heat shrinkage different from the other by at least 5%, the space ratio of the cloth being 0.4 to 0.98, and the thickness of the cloth being 1 to 15 mm, as well as a cloth of a three-dimensional structure which is obtained by heat-treating the above cloth to develop an uneven appearance. In the above cloth of the three-dimensional structure, the fabric textures of the front and back surfaces are connected with the connecting yarns, the yarns each having the heat shrinkage different from the other are used, the yarns are subjected to heat-shrinkage thereby to form the raised and depressed portions on the surface. Basically, this cloth is a relatively thin structure formed of the front and back fabrics. A cloth having a thickness of 6.5 mm is actually shown in the document. This document indicates that the above cloth is used as a surface material for a mattress, a sheet, a bed pad and a clothing. Accordingly, the cloth is thin and has low cushioning properties.

(4) U.S. Pat. No. 4,015,641

This document includes the description about "a narrow woven tubular fabric having a flattened oval cross-section, said fabric comprising an upper layer and a lower layer, both of said layers containing monofilament filling yarns, said monofilament filling yarns having a denier between 100 to 2080, said layers being connected together along their longitudinal edges and said layers being resiliently separated by a plurality of monofilament warp yarns alternately intermittently woven with each of said layers, said monofilament warp yarns having a denier of between 100 to 2080, the sum of the denier of a monofilament filling yarn plus a monofilament warp yarn being in the range of from 430 denier to 4200 denier and the ratio of denier of monofilament filling yarn to monofilament warp yarn being from 20:1 to 1:20."

In brief, the above invention relates to a narrow woven tubular fabric with two layers resiliently separated from one another to provide a cushion or sponge effect. This fabric is used in shoulder straps of brassieres, straps on knapsacks or back-packing equipment or straps on scuba diving equipment. Accordingly, the above fabric is a narrow structure such as the straps, and has low cushioning properties. Thus, the fabric cannot be used as a cushioning material for bed pad or vehicle sheet.

As noted above, the ordinary cushioning structures, when used in bed, a sheet for vehicles, a sheet for chair, a sheet for Japanese cushion, a sports material and the like, were not said to satisfy such conditions required of the cushioning structure that heat or swear generated from a human body is absorbed, a durability is provided and a pressure distribution is uniform.

It is a first object of this invention to provide a cushioning structure having a new structure that solves the defects associated with the cushioning structures in the above prior arts.

A second object of this invention is to provide a cushioning structure excellent in cushioning properties, uniformity of a pressure distribution without causing a bottom-hit feel, air permeability, washability and durability.

A third object of this invention is to provide a cushioning structure which is relatively light in weight and can be used over wide fields such as bed, a sheet for vehicles, a sheet for chair, a sheet for Japanese cushion, a drawing-room suite, a sports material and the like.

According to the researches of the present inventors, it has been found that the objects of this invention are achieved by a cushioning structure which is a three-dimensional multiple woven texture constituted by a spatial surface layer portion and a spatial intermediate layer portion, characterized in that (i) protuberances are formed on one side or both sides of the surface layer portion at least unidirectionally and has an average height of 2 to 15 mm, an average width of one side of the protuberance being 2 to 30 mm; and that (ii) said intermediate layer portion is formed of one or more layers each having a plurality of communicating hollow portions which are arranged in parallel unidirectionally.

Figure 2:
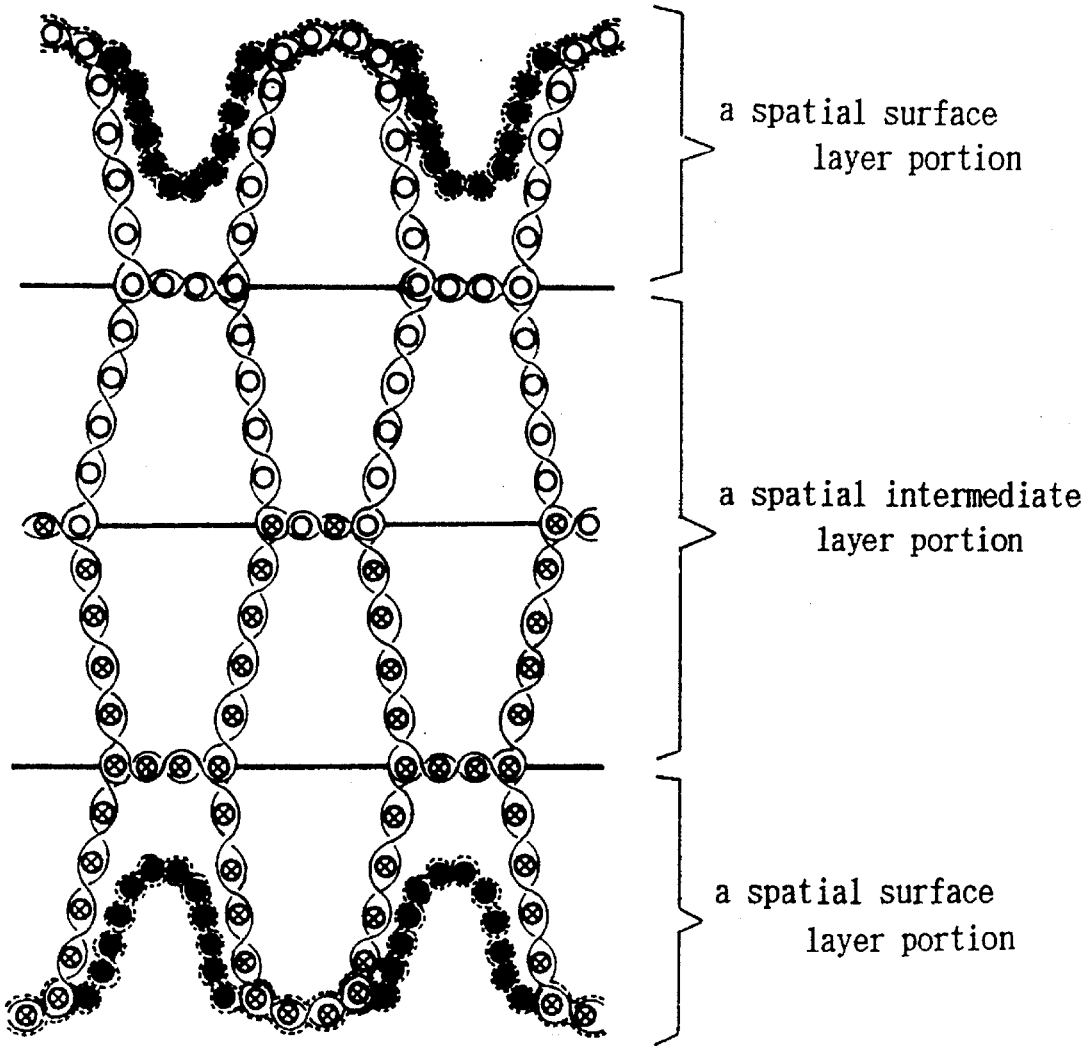
Figure 3:
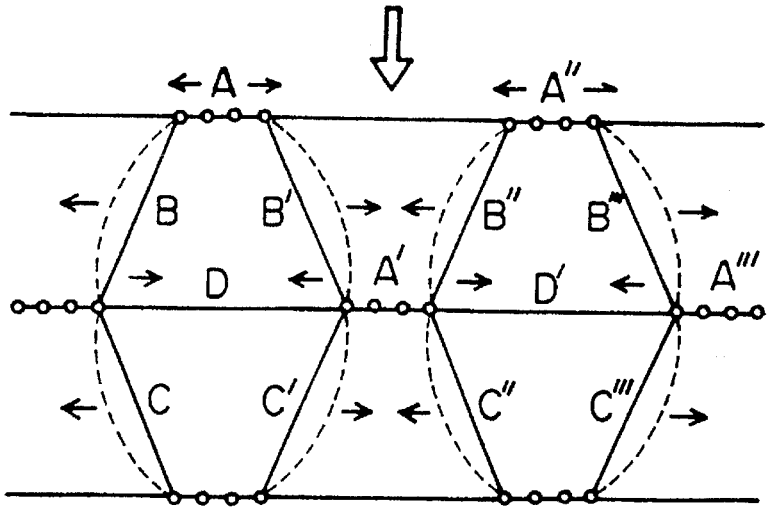
Figure 4:
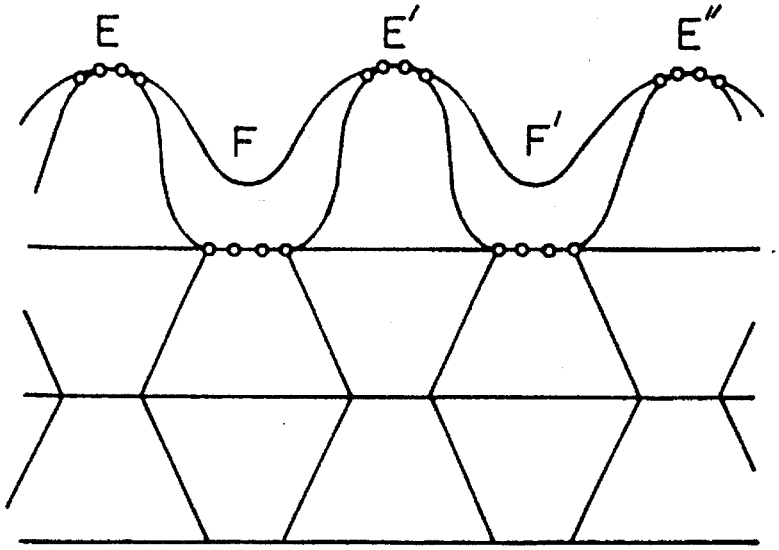
Figure 5:
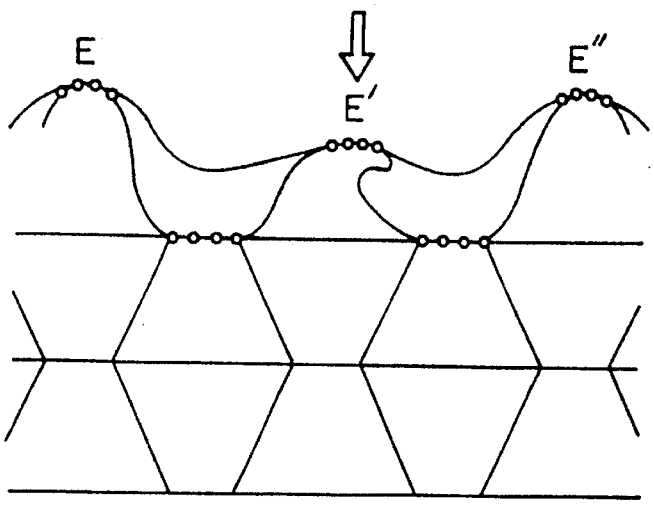
Figure 6:
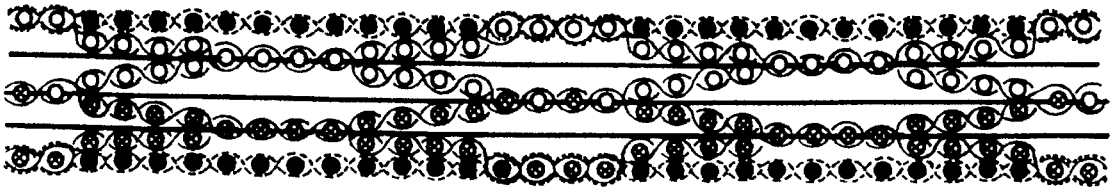

FIG. 1 is a schematic view of a cross section of a cushioning structure obtained in Example 1. FIG. 2 is a schematic view of a cross section of a cushioning structure obtained in Example 2. FIG. 3 a schematic view of a cross section of a portion in which two layers having communicating hollow portions are formed In an intermediate layer portion of the cushioning structure of this invention. FIG. 4 is a schematic view of a state where a woven fabric using stretchable bulky yarns is integrally fabricated between the tops of the protuberances in the surface layer portion by the woven texture on the surface layer portion of the cushioning structure of this invention. FIG. 5 is a schematic view of a cross section in a state where a pressure is partially exerted in the state shown in FIG. 4. FIG. 6 is a schematic view of a cross section of a woven fabric (not shrunk) obtained in Example 2.

The cushioning structure of this invention is a three-dimensional structure obtained by texturing a woven fabric of filament fibers and formed of a spatial surface layer portion and a spatial intermediate layer portion, said surface layer portion having a structure that it is integrally formed on one side or both sides of the intermediate layer portion. Said cushioning structure is characterized in that protuberances having a fixed size and a fixed shape are formed on the surface layer portion, and the intermediate layer portion is formed of one or more layers each having a plurality of communicating hollow portions which are arranged in parallel unidirectionally.

The three-dimensional multiple woven texture of this invention is substantially formed of a filament fiber. Such a fiber may be an ordinary fiber. Examples of the fiber include a polyester fiber, a polyamide fiber (nylon fiber), an aromatic polyamide fiber, a polyvinyl alcohol fiber, a polypropylene fiber, a polyethylene fiber and a glass fiber. These fibers can be used in combination of two or more. Especially, it is preferred to use a combination of the nylon fiber and the polyester fiber. The filament of the filament fiber is a monofilament or a multifilament. A warp filament constituting the monofilament is a nylon filament excellent in deformation recovery.

The cushioning structure which is the three-dimensional multiple woven texture of this invention has the surface layer portion in which protuberances are formed on one side or both sides thereof. The protuberances may be unidirectional protuberances, i.e., wavy protuberances or trapezoidal protuberances. It is desirous that the cross section of the protuberance takes a shape of a gentle curve. It is advisable that the shape of the protuberance on the surface is regularly formed such that a depression formed between the two adjacent protuberances on the surface has an inverse protuberance shape.

The protuberances on the surface layer portion may be, as shown in FIG. 1, formed on both sides or on one side only. The protuberance can take a wavy shape, as shown in FIG. 1, which is formed unidirectionally. A height of the protuberance corresponds to a straight distance from the surface of the intermediate layer portion in contact with the protuberance to the top of the protuberance. It is on the average 2 to 15 mm, preferably 3 to 13 mm. The width of one side of the protuberance (on the average a straight distance between the tops of the two adjacent protuberances) is on the average 2 to 30 mm, preferably 3 to 25 mm. The ratio of height of the protuberance/width of one side of the protuberance is 1/5 to 2/1, preferably 1/4 to 3/2.

it is desirable that the height of the protuberance is 1/3 or less, preferably 1/4 or less of the thickness of the cushioning structure. When the height of the protuberance is lower than 2 mm, the pressure is hardly distributed uniformly. On the other hand, when it exceeds 15 mm, the cushioning structure tends to bend and collapse due to the pressure. This is, therefore, undesirable. When the width of one side of the protuberance is less than 2 mm, the surface layer portion becomes too flat, and the pressure is hardly distributed uniformly. On the other hand, when the width of one side of the protuberance exceeds 30 mm, the pressure is likewise hardly distributed uniformly.

The woven fabric forming the surface layer portion is, as shown in FIGS. 1 and 2, integrally woven texturally into the surface of the intermediate layer portion on the bottom of the protuberance.

The cushioning structure formed of the three-dimensional multiple woven texture of this invention has the intermediate layer portion as shown in FIGS. 1 and 2. The intermediate layer portion may be formed of single layer as shown in FIG. 1, two layers as shown in FIG. 2 or three layers. In case of two or more layers, the layers are integrally laminated. From the aspects of ease of the production and practical use, it is suitable that the intermediate layer portion is formed of two or three layers.

The one layer forming the intermediate layer portion has a plurality of communicating hollow portions which are arranged in parallel unidirectionally in the cross section. The shape of the cross section intersecting perpendicularly to the longitudinal direction, of the communicating hollow portion is approximately trapezoidal, which is advantageous for cushioning properties and durability. It is advisable that the trapezoid in the cross section is so designed that the two trapezoids next to each other form together a parallelogram and the parallelogram is repeated as one unit in one layer.

In case of laminating two or three layers having the plurality of the communicating hollow portions, it is more preferable for cushioning properties and durability that the cross sectional shapes of the communicating hollow portions are symmetrical about the laminating surface in the laminating direction. This is specifically explained below by referring to FIG. 3.

FIG. 3 is a schematic view of a cross section of a portion formed by laminating two layers having communicating hollow portions in the intermediate layer portion. In FIG. 3, a trapezoid (X) surrounded by four sides A, B, B' and D is formed. The same trapezoid (Y) is formed by four sides A", B", B"' and D'. A trapezoid of the same shape as that of these trapezoids is formed inversely between the trapezoids (X) and (Y). On the layer under the layer in which the trapezoids (X) and (Y) are formed, the respective trapezoids are symmetrically formed via sides D and D' (laminating surfaces).

For example, in FIG. 3, when a pressure is exerted on the upper surface of the intermediate layer portion as shown by a white arrow, the pressure is applied in a left direction on the sides B, B", C and C", while the pressure is applied in a right direction on the sides B', B"', C' and C"'. Thus, the individual sides are curled, as shown in dotted lines, toward the outside of the trapezoids. The whole cushioning properties are exhibited by the curling force. On the other hand, the force is applied internally (in the arrow direction) to the sides D and D', but filament yarns obtained by shrinking highly shrinkable yarns are not elongated on the sides D and D', with the consequence a fiber hardly causes a fatigue and has a durability. Meanwhile, monofilament yarns (warps or warps and wefts) of the portions A and A" are textured, and though a pulling force is applied thereto, they are hard to flow. Accordingly, that the cross sectional shape of the communicating hollow portion in the intermediate layer portion is trapezoidal and the plurality of the communicating hollow portions are gathered and laminated to form a honeycomb structure as a whole is considered to contribute to exhibiting the cushioning properties and the durability of the cushioning structure.

In the communicating hollow portions in the intermediate layer portion, the plurality of the hollow portions that communicate in the intermediate layer portion are present in parallel unidirectionally. However, one hollow portion does not necessarily communicate completely from one end to another in the cushioning structure. That is, the hollow portion may be closed in one part by stitching, sewing with a machine or the like so far as a performance as a structure is maintained, and it is sufficient that the communicating hollow portions may usually communicate with one another with a length of 5 cm or more, preferably 10 cm or more. Especially, there can be also achieved an effect that removal of a filament yarn from the end relative to the communicating direction of the hollow portion can be prevented by closing the hollow portion at the end of the cushioning structure through sewing with a machine.

In the cushioning structure of this invention, the number of the layers having the plurality of the communicating hollow portions in the intermediate layer portion is 1 to 5, preferably 1 to 3, and the surface layer portions having the protuberances are formed on one side or both sides, preferably both sides, of the intermediate layer portion. The practical thickness of the structure is 10 to 50 mm, preferably 15 to 40 mm. For special usages, the structure may be thicker. Especially as a cushioning structure for bed pad, the intermediate layer portion is preferably formed of two or three layers.

The cushioning structure of this invention is formed substantially of filament fibers and three-dimensionally textured. Accordingly, the space ratio is as high as 90% or more, preferably 93% or more. Therefore, the cushioning structure is very light in weight as a whole and easy to carry.

Further, in the cushioning structure of this invention, a compression pressure required to compress said cushioning structure in the thickness direction by 10 mm is 20 to 300 g/cm$^2$, preferably 30 to 250 g/cm$^2$, and an air permeability is at least 20 cc/cm$^2$·sec, preferably 30 to 500 g/cm$^2$·sec, especially preferably 40 to 350 g/cm$^2$·sec. Thus, the cushioning structure of this invention has both the suitable compression pressure and the excellent air permeability. Therefore, when the cushioning structure of this invention is used, for example, as bed, a wet feeling is reduced and a pressure is suitably distributed uniformly, to thereby give a comfortable feeling in bed. Particularly, when the cushioning structure is used as bed for patients requiring a long-term medical care, it is hygienically good and effective for prevention against bedsore.

According to the researches of the present inventors, it has been found that the cushioning structure in which the woven fabric using stretchable bulky yarns as a warp or a warp and a weft are integrally fabricated in the protuberances on the surface of the surface layer portion having the protuberances formed thereon by the woven texture feels soft in touching the surface, gives a soft feeling in contact with a body, and is therefore much superior as a cushioning material.

When the woven fabric is thus further integrated with the surface layer portion having the protuberances, it is advisable that in the cross section of the surface layer portion, an apparent length for forming the two adjacent protuberances of the surface layer portion is longer by 10 to 100%, preferably 15 to 90% than an apparent length for forming the two adjacent protuberances of the woven fabric fabricated in the surface layer portion. That is, it is preferable that the woven fabric is integrally fabricated between the tops of the two adjacent protuberances in the surface layer portion in such a state that the woven fabric is bridged therebetween in a depressed state which is gentler than the depressed state formed by said two protuberances. Besides, it is especially preferable that the stretchable bulky yarns of the woven fabric fabricated in the surface layer portion are woven in a crimped state (i.e., in a state where the crimp is developed) between the two adjacent protuberances.

When the structure in which the woven fabric formed of the stretchable bulky yarns is fabricated in the surface layer portion in the above-mentioned state is used as a cushioning material and when a pressure is exerted on such structure, the pressure is uniformly distributed as a whole and a pressure resistance is distributed uniformly in a wide region even if one of the protuberances is independently deforms due to the pressure; this is because the length of the surface of the woven fabric is properly short and the woven fabric is crimped. This is explained below by referring to FIGS. 4 and 5.

FIGS. 4 and 5 are schematic views of a cross section in a state where a surface layer portion having protuberances is formed on one side of an intermediate layer portion obtained by laminating two layers having communicating hollow portions and a woven fabric formed of stretchable bulky yarns is integrally fabricated between the tops of the protuberances on the surface layer portion by the woven texture. In FIGS. 4 and 5, E, E' and E" are the tops of the protuberances on the surface layer portion wherein the woven fabric is integrated. F and F' are depressions of the woven fabric formed between the two adjacent protuberances. FIG. 4 shows a state where a pressure is not applied, and FIG. 5 shows a state where a pressure is applied to the top E' of the protuberance. In FIG. 5, the shape of the top E' of the protuberance bends and collapses, but the depressions F and F' of the woven fabric rise, and the structure flattens owing to the pressure. Thus, the force to pull the top of the adjacent protuberances E and E" is applied to the surface of the woven fabric, whereby the pressure is distributed uniformly.

The cushioning structure of this invention is a three-dimensional woven structure which makes use of spaces of the multiple woven texture. This structure is quite low in fiber fillability and has a raised/depressed structure of a specific shape on the surface. Therefore, the cushioning structure is excellent in air permeability, cushioning properties, uniformily of pressure distribution and washability. Accordingly, the cushioning structure of this invention is suited for bed pad, pillow, chair, vehicle sheet and the like.

In particular, since the cushioning structure of this invention is a flat material having a thickness of about 10 to 50 mm, it can be used as a cushioning material of a bed pad. In this case, a cushioning structure of a predetermined size can be used as a cushioning material for bed pad by accommodating it into a cover of an ordinary cloth. For heat insulation, it is advisable that the cushioning structure is accommodated within a cover having an air permeability of 5 $cc/cm^2 \cdot sec$ or less. A cushioning structure having a thickness of 20 to 40 mm, especially 25 to 35 mm is suitable for bed pad. The cushioning structure may be directly laid on a bed pad or on a bed pad stuffed with short fibers or cotton. Or the cushioning structure may be laid on a carpet. In this case, too, it feels also quite comfortable.

Further, the cushioning structure of this invention is, as mentioned above, quite excellent in air permeability and excellent in uniformity of pressure distribution. Consequently, when said cushioning structure is used as a cushioning material for bed pad, it provides a comfortable feeling in bed but not a wet feeling in bed.

In particular, the cushioning material for bed pad using the cushioning structure of this invention is quite effective for prevention against a bedsore of a patient who has to undergo long-term medical care in bed. In order to prevent the bedsore of the patient under the long-term medical care in bed, a change of his posture is usually required every 2 or 3 hours with the conventional bed pad. However, when the bed pad using the cushioning structure of this invention is employed, no substantial bedsore is observed even if the posture is changed every 4 or 5 hours. This shows that the cushioning structure of this invention is quite excellent in air permeability and excellent in uniformity of pressure distribution.

Further, the cushioning structure of this invention is quite excellent in durability. For example, when the cushioning structure of this invention is used every day as a cushioning material for bed pad, no substantial change is observed, after three or more years, with respect to the compression pressure and the uniformity of pressure distribution.

[EXAMPLES]

This invention will be illustrated specifically by referring to the following Examples. In the Examples, the following properties were measured by apparatus and conditions mentioned below.

(1) Air permeability

Air permeability was measured with JISL-1079 (Frazier-type air permeability tester). Air was drawn in such that a pressure difference became ½ inch, and an amount of flowing air per unit area and unit time on that occasion was taken as the air permeability.

(2) Stress distribution

A stress distribution of a sacrum portion was measured with a TEX·SCAN tactile sensor system manufactured by Nitta K. K. The pressure sensor has a size of 43 cm×48 cm, and has an ability to measure a pressure at each of spots by 10 mm apart.

(3) Compression pressure

A sample material was compressed at a rate of 50 mm/min using a compression disc described in JISK-6401-5.4.2, and the pressure was measured when the sample was compressed by 10 mm.

(4) Degree of collapse

Loading and unloading of a 200 kg weight in an area having a diameter of 20 cm was repeated 50,000 times, and a change in thickness before and after the test was measured. A degree of collapse was shown by a ratio (%) of the decreased thickness to the thickness before measured.

Example 1

A copolyethylene terephthalate fiber containing 13 mol %, based on the total acid components, of an isophthalic acid component was used as a highly shrinkable yarn. A denier of a monofilament in this yarn was 4, a total denier was 1,000, an intrinsic viscosity [η] was 0.8, a strength was 5.5 g/de, a thermal shrinkage stress value was 0.52 g/de, and a boiling-off water shrinkage factor was 47% (using SOCRATEX, a trade name for a yarn manufactured by Teijin Limited).

As a warp, two layers of the highly shrinkable yarns (each layer 19 ends/inch) in an intermediate layer portion and three layers of nylon monofilaments having a denier of 440 (each layer 36 filaments/inch) were respectively wound on two beams, and a warp of four-fold weave was prepared using the double-beams. As a weft, four layers all formed of polyethylene terephthalate monofilaments having a denier of 400 (each layer 36 ends/inch) were used. The thus obtained warp and weft were woven. The woven fabric was set at a dry heat of 170° C. and the highly shrinkable yarns as the warp were shrunk to obtain a highly air-permeable cushioning structure having a thickness of 25 mm, a cross sectional shape of said structure being shown in FIG. 1.

In FIG. 1, a white circle (○) shows a polyethylene terephthalate monofilament (weft) having a denier of 400, and a warp woven in the white circle shows a nylon monofilament having a denier of 440. Two solid lines which were drawn in parallel laterally, as shown in FIG. 1, show originally highly shrinkable yarns which have been shrunk, and the intermediate layer portion (single layer) was formed by the two highly shrinked yarns.

Example 2

As a warp, three layers of the same highly shrinkable yarns (total denier 1,000) as those used in Example 1 (each layer 19 ends/inch) in an intermediate layer portion, four layers of nylon monofilaments having a denier of 330 (each layer 36 ends/inch), and polyethylene terephthalate woollie yarns SD (144 filaments having a denier of 475: KG156W supplied by Teijin Limited) as outermost layers (each layer 36 yarns/inch) were respectively wound on three beams, and a modified five-fold weave was formed by the triple beams with a Rapier loom (having a dobby). At this time, polyethylene terephthalate woollie yarns SD (144 filaments having a denier of 475) were used as a weft outer layer, and the polyethylene terephthalate monofilaments having a denier of 300 were woven in the four layers of the intermediate layer portion to obtain a woven fabric of a structure shown in FIG. 6. The obtained woven fabric was set at 170° C. for about 2 minutes, and the highly shrinkable yarns were shrunk by 40% in the longitudinal direction of the woven fabric to obtain a highly air-permeable cushioning structure having a thickness of 30 mm, a cross sectional shape of said structure being shown in FIG. 2.

In FIG. 2 (also in FIG. 6), a black circle (●) of the weft shows a polyethylene terephthalate woollie yarn. A dotted line woven in the black circle is a warp of a polyethylene terephthalate woollie yarn. A white circle and a circle with cross (x mark inside the white circle) show warps of polyethylene terephthalate monofilaments. Solid lines woven in the white circle and the circle with cross show wefts of nylon monofilaments. The highly shrinkable yarns (three thick solid lines drawn in parallel laterally) are formed by three layers which form an intermediate layer portion (two layers). The polyethylene terephthalate woollie yarns, the nylon monofilaments and the highly shrinkable yarns are integrated texturally with one another in some portions, as shown FIG. 2.

The properties of the cushioning structures obtained in Examples 1 and 2 are shown in Table 1.

TABLE 1

| | Properties | Example 1 | Example 2 |
|---|---|---|---|
| 1 | Compression pressure (g/cm$^2$) | 65 | 40 |
| 2 | Air permeability (cc/cm$^2$.sec) | 800 | 78 |
| 3 | Texture fillability (%) [Space ratio %] | 4 [96] | 4.5 [95.5] |
| 4 | Degree of collapse (%) | 5.8 | 4.5 |
| 5 | Stress distribution | All 100 g/cm$^2$ or less | All 70 g/cm$^2$ or less |
| 6 | Height of a protuberance on a surface layer portion (mm) | 7 | 4 |
| | Width of one side of the protuberance on the surface layer portion (mm) | 16 | 16 |
| 7 | Total thickness (mm) | 25 | 30 |

Example 3

Portions which were 10 cm spaced apart from both ends in the longitudinal (warp) direction of the cushioning structure obtained in Example 2 were sewed with a machine. The longitudinal and lateral ends were subjected to a piping-Adler processing with a piping tape having a width of 70 mm (a tape obtained by laminating a urethane film having a back surface of 100 μ in thickness on a back surface of a pile tricot and slitting the laminate with a width of 70 mm) with a special machine in which Adler-205 type sewing machine (a trade name for a machine manufactured by Durkoepp Adler GmbH) was fitted with a head and a V-shaped element. There was obtained a bed mattress formed of the good cushioning structure.

Removal of the yarn at the end was not observed in this bed mattress. As to the properties, the air permeability was 76 cc/cm$^2$·sec, and the other properties were almost the same as those in Example 2.

Example 4

As a warp, three layers of the same highly shrinkable yarns (total denier 1,000) as those used in Example 1 (each layer 19 ends/inch) in an intermediate layer portion, four layers of nylon monofilaments having a denier of 440 (each layer 36 ends/inch), and polyethylene terephthalate woollie yarns SD (144 filaments having a denier of 475: KG156W supplied by Teijin Ltd.) as outermost layers (each layer 36 ends/inch) were respectively wound on three beams, and a modified five-fold weave (9 layers) was formed by the triple beams with a Rapier loom (having a dobby). At this time, polyethylene terephthalate woollie yarns SD (144 filaments having a denier of 475) were used as a weft outer layer (32.35 filaments/inch), and the polyethylene terephthalate monofilaments having a denier of 300 (60.65 monofilaments/inch) were woven in the four layers of the intermediate layer portion to obtain a woven fabric of a structure shown in FIG. 6. The obtained woven fabric was set at 130° C. for about 2 minutes, and the highly shrinkable yarns were shrunk by 38% in the longitudinal direction of the woven fabric to obtain a highly air-permeable cushioning structure having a thickness of 30.5 mm, a cross sectional shape of said structure being shown in FIG. 2. The properties of the obtained cushioning structure are shown in Table 2.

TABLE 2

| | Properties | Example 4 |
|---|---|---|
| 1 | Compression pressure (g/cm$^2$) | 60 |
| 2 | Air permeability (cc/cm$^2$.sec) | 170 |
| 3 | Texture fillability (%) [Space ratio %] | 3.2 [96.8] |
| 4 | Degree of collapse (%) | 2.4 |
| 5 | Stress distribution | All 107 g/cm$^2$ or less |
| 6 | Height of a protuberance on a surface layer portion (mm) | 4.5 |
| | Width of one side of the protuberance on the surface layer portion (mm) | 16.5 |
| 7 | Total thickness (mm) | 30.5 |

Example 5 (Measurement of pressure distribution)

A cushioning material for bed pad having a width of 92 cm, a length of 195 cm and a thickness of 3.05 cm was prepared by using the cushioning structure obtained in Example 4. This cushioning structure was used by accommodating it into an ordinary cotton plain fabric (the density of 77 ends/inch and 140 pick/inch using cotton yarn of 40 s/1).

The pressure distribution of the cushioning material for bed pad was measured in each of the following modes by laying said cushioning material on a carpet or on a standard bed pad which was placed on the carpet.

A grown-up man (height 175, weight 70 kg) lied on his back on the bed pad in each mode, and a pressure sensor was placed between his hip and the bed pad. In this posture, the distribution of the pressure exerted on the hip was measured. A tactile sensor system GSCAN (BIG-MAT) manufactured by Nitta K. K. was used as a measuring instrument. This measuring instrument can measure the pressure exerted on the hip with a unit of 1 cm$^2$.

The modes of the cushioning structure are shown below.

Mode 1: a carpet only

Mode 2: a combination of a carpet and a standard bed pad placed thereon

Mode 3: a combination of a carpet and the cushioning material for bed pad placed thereon Mode 4: a combination of a carpet, a standard bed pad placed on the carpet and the cushioning material for bed pad placed on the standard bed pad In this measurement, there were used a needle punch carpet having a width of 92 cm, a length of 195 cm and a thickness of 5 mm and a standard bed pad obtained by uniformly packing a cotton into a cloth bag and having a width of 92 cm, a length of 195 cm, a thickness of 7 cm (no load), and a weight of 5.8 kg. The results are shown in Table 3. In the Table 3, the figures indicate areas (cm$^2$) that responded to the respective pressures (g/cm$^2$).

TABLE 3

| | Pressure (g/cm$^2$) | | | | | | | | | | | | | |
|---|---|---|---|---|---|---|---|---|---|---|---|---|---|---|
| | 0–15 | 15–27 | 27–38 | 38–50 | 50–62 | 62–74 | 74–83 | 83–95 | 95–107 | 107–118 | 118–130 | 130–142 | 142–150 | Total |
| Model 1: | 169 | 96 | 90 | 17 | 15 | 10 | 12 | 8 | 18 | 4 | 10 | 5 | 53 | 507 |
| Model 2: | 194 | 108 | 105 | 60 | 39 | 22 | 26 | 14 | 32 | 16 | 11 | 4 | 31 | 662 |
| Model 3: | 193 | 117 | 76 | 64 | 36 | 20 | 20 | 12 | 41 | 14 | 5 | 1 | 10 | 609 |
| Model 4: | 265 | 160 | 85 | 55 | 33 | 14 | 15 | 2 | 20 | 0 | 0 | 0 | 0 | 649 |

The above Table 3 reveals that in modes 3 and 4 using the cushioning structure of this invention, the pressure is widely distributed as compared to the other modes not using the cushioning structure of this invention. That is, in regard to the total of the unit area (cm$^2$) to which a great load (e.g., greater than 107 g/cm$^2$) is exerted, mode 3 is reduced compared with mode 1, and mode 4 is much reduced compared with mode 2.

Example 6 (bedsore test)

Five patients who have to be under medical care in bed and cannot change their postures by themselves used the cushioning structure of this invention as a bed pad, and the effect for prevention against bedsore was examined.

They used the cushioning material for bed pad obtained in Example 4 in mode 4, and lied thereon for six months.

Their postures were changed every 4 or 5 hours for six months. Consequently, no bedsore was observed on any one of the five patients. In order to prevent the bedsore with the ordinary bed pad (e.g., mode 2), it was required to change the posture every 2 hours. From this fact, it follows that the cushioning structure of this invention is excellent in air permeability and uniformity of pressure distribution.

[Effects of the Invention]

In accordance with this invention, there is provided a cushioning structure excellent in air permeability, cushioning properties, uniformity of pressure distribution, durability, washability and soft feeling to touch. It is useful as a cushioning material for use in a bed, a sheet for vehicles, a sheet for chair, a sheet for Japanese cushion, a sheet for drawing-room suite, a sports material and the like.

We claim:

1. A cushioning structure which is a three-dimensional multiple woven texture constituted by a spatial surface layer portion and a spatial intermediate layer portion, characterized in that (i) protuberances are formed on one side or both sides of the surface layer portion at least unidirectionally and have an average height of 2 to 15 mm, an average width of one side of the protuberance being 2 to 30 mm; and that (ii) said intermediate layer portion is formed of one or more layers, each layer having a plurality of communicating hollow portions which are arranged in parallel unidirectionally.

2. The cushioning structure of claim 1 wherein the cross section, perpendicular to the longitudinal direction, of the communicating hollow portion in the intermediate layer portion has a shape of trapezoid.

3. The cushioning structure of claim 1 wherein the cross section, relative to the longitudinal direction, of two adjacent communicating hollow portions of one layer in the intermediate layer portion has a shape of parallelogram.

4. The cushioning structure of claim 1 which has a thickness of 10 to 50 mm.

5. The cushioning structure of claim 1 wherein a compression pressure required to compress the cushioning structure by 10 mm in the thickness direction is 20 to 300 g/cm$^2$.

6. The cushioning structure of claim 1 which has a space ratio of at least 90%.

7. The cushioning structure of claim 1 which has an air permeability of at least 20 cc/cm$^2$·sec.

8. The cushioning structure of claim 1 wherein wavy protuberances are formed on one side or both sides of the surface layer portion.

9. The cushioning structure of claim 1 wherein on the surface of the surface layer portion on which the protuberances are formed, a woven fabric in which shrinkable bulky yarns are used as a warp or a warp and a weft is integrally fabricated in the tops of the protuberances by the woven texture.

10. The cushioning structure of claim 9 wherein in the cross section in the surface layer portion, an apparent length for forming two adjacent protuberances of the surface layer portion is longer by 10 to 100% than an apparent length for forming the two adjacent protuberances of the woven fabric integrally fabricated in the surface layer portion.

11. The cushioning structure of claim 9 wherein the stretchable bulky yarns of the woven fabric integrally fabricated in the surface layer portion are woven between the two adjacent protuberances in a crimped state.

12. A cushioning material for vehicle, chair or Japanese cushion which uses the cushioning structure of claim 1.

13. A cushioning material for bed pad wherein the cushioning structure of claim 1 is accommodated in a cloth cover.

14. The cushioning material of claim 13 wherein an air permeability of the cloth cover is 5 cc/cm$^2$·sec or less.

* * * * *